US006793087B2

(12) United States Patent
Dyrèn

(10) Patent No.: US 6,793,087 B2
(45) Date of Patent: Sep. 21, 2004

(54) SEALING DEVICE

(75) Inventor: Leif Dyrèn, Järfälla (SE)

(73) Assignee: Effektivator Foretagens Ledningsresurs, Jarfalla (SE)

( * ) Notice: Subject to any disclaimer, the term of this patent is extended or adjusted under 35 U.S.C. 154(b) by 1 day.

(21) Appl. No.: 10/186,845

(22) Filed: Jun. 28, 2002

(65) Prior Publication Data

US 2003/0000952 A1 Jan. 2, 2003

Related U.S. Application Data

(60) Provisional application No. 60/305,028, filed on Jul. 12, 2001.

(51) Int. Cl.[7] ..... B65D 17/34

(52) U.S. Cl. ..... 220/254.4; 220/258.4; 220/269; 220/730

(58) Field of Search ..... 220/254.4, 258.1, 220/258.3, 258.4, 258.5, 269, 906, 821, 824, 729, 730

(56) References Cited

U.S. PATENT DOCUMENTS 4,537,326 A * 8/1985 Morehead ..... 220/269
4,605,141 A * 8/1986 Won ..... 220/269
4,951,835 A * 8/1990 DeMars et al. ..... 220/269
5,080,249 A * 1/1992 Shock ..... 220/269
5,555,993 A * 9/1996 Borkowski et al. ..... 220/269
5,975,327 A * 11/1999 Funk ..... 220/269
2001/0032852 A1 * 10/2001 Naude ..... 220/269

* cited by examiner

*Primary Examiner*—Nathan J. Newhouse
(74) *Attorney, Agent, or Firm*—Renner, Otto, Boisselle & Sklar, LLP

(57) ABSTRACT

Sealing device having an essentially flat opening area (14), an opening tab (18) formed in the opening area and an opening device (30) attached at a connection point (32) in the opening area. Moreover, through leverage action, the sealing device is arranged to press down the opening tab in the opening area so that it creates an opening therein. After the opening is created, opening device (30) is arranged so that it can be twisted parallel with opening area (14) around connection point (32) until it reaches a resealing position where it closes the opening with a covering surface. To make it possible, in a simple manner, to block opening device (30) at the resealing position, it is proposed that among other things opening device (30) be provided at its periphery with blocking devices including at least one tab (36, 40) formed so that opening device (30) alternately engages the upper and lower edge areas of opening (22).

4 Claims, 3 Drawing Sheets

SEALING DEVICE

This application the benefit of Provisional Application No. 60/305,028 filed Jul. 12, 2001.

TECHNOLOGY FIELD

This invention comprises a sealing device for a container having an essentially flat opening area, an opening tab formed in the opening area and an opening device attached at a connection point in the opening area. Moreover, through leverage action, the opening device is arranged to press down the opening tab in the opening area so that it creates an opening therein, whereupon the opening device, after having created the opening, is arranged to provide resealing of the opening in such a way that the opening device is twisted around the connection point in parallel with the opening area until it reaches the resealing position where it seals the opening with a covering surface.

KNOWN TECHNOLOGY

Such sealing devices are usually found on what are often called returnable aluminium cans. Since the contents of such a can is often not completely consumed immediately after opening, it is desirable to, in a simple manner, be able to reseal the can so that the rest of its contents can be used later with reduced risk for its having been affected in any way from external sources. It should be noted that glasses are sometimes not used to drink the contents of cans. Instead, many people drink directly from the cans themselves. This applies, not least, to soft drink cans in the summer when there is risk that wasps, for example, will get into the cans.

A re-sealable sealing device of the type set forth in the above introduction is known previously through U.S. Pat. No. 4,877,129. In this resealing device, the opening device can be blocked in the resealing position by having a recessed covering surface pressed down into the opening so that it engages the edge of the opening.

SUMMARY OF THE INVENTION

One purpose of this invention is to provide a sealing device of the type set forth in the above introduction which, in a simple manner, can reseal and be blocked in the resealing position.

This is achieved by means of the characteristics set forth in the claims that follow.

In accordance with one embodiment of the invention, the opening device has, at its periphery, a blocking device that includes at least one tab formed so that the opening device alternately engages the upper and lower edge areas of the opening in order to block the opening device at the resealing position.

Other characteristics and advantages of the invention are set forth in the claims and in the following detailed description of one example of an embodiment.

DESCRIPTION OF AN EXAMPLE OF AN EMBODIMENT

Figure 1:
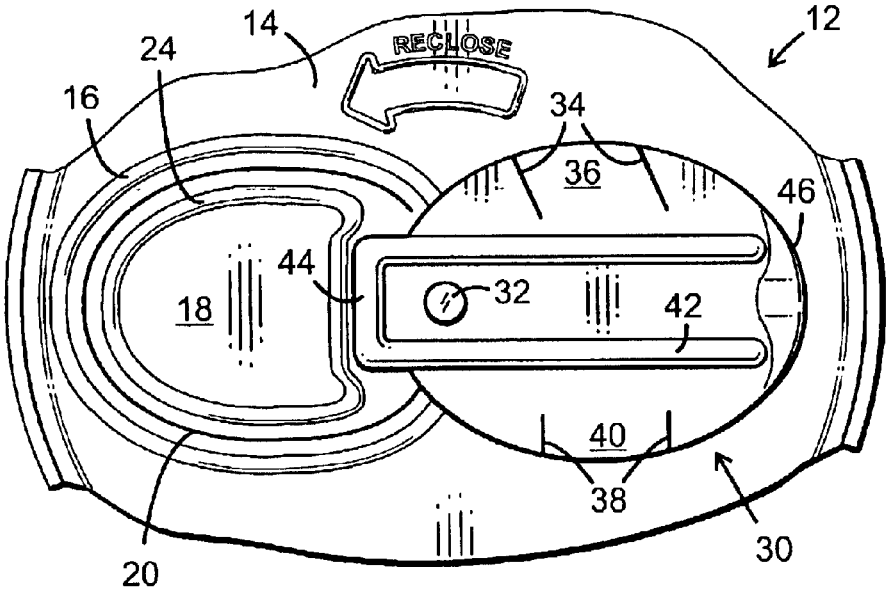
FIG. 1 shows a part of the top of a can cover provided with a sealing device in accordance with this invention that is in the unopened position.

The returnable cans 10 shown in the drawings are basically of the pop-top type that has been known for 35 years, on which an opening device 30 is joined to the can cover 12 via a connection point configured as a rivet 32 formulated in the surface of the cover 12. An opening tab 18 (FIG. 1) is created by means of a score 20 in the essentially flat opening area 14 of cover 12, said score 20 having, typically, a depth of less than half of the thickness of the material in opening area 14. The can is opened in the known way by pressing down, through leverage action, on the opening tab 18, such pressure being exerted via the inner end 44 of opening device 30 so that score 20 splits loose and tab 18 is pressed down into can 10 thereby creating opening 22 when opening device 30 is lifted at its outer end 46. To make it easier for score 20 to split loose completely during the opening operation, reinforcing grooves 16, 24 are usually provided on both sides of score 20 in opening area 14. As indicated in FIGS. 2 and 3, these grooves can also be omitted, and in such case the can cover may perhaps be made of thicker material.

While the opening device on known returnable cans is usually shaped like an internally open ring, opening device 30, in accordance with this invention, is shaped as a disc/plate comprising a covering surface. This covering surface is larger than the area of opening 22 so that opening device 30, after the opening operation, can be twisted a half revolution around connection point 32 and then fully cover opening 22. More precisely, after the opening operation, opening device 30 is first pressed back against opening area 14 as shown in FIG. 2 and then twisted in the direction shown by the arrow to the resealing position shown in FIG. 3. No modification of the connection comprising rivet 32 is needed to make this twisting possible since, in the form known today, it already allows twisting of the internally open ring relative to the can cover.

Figure 2:
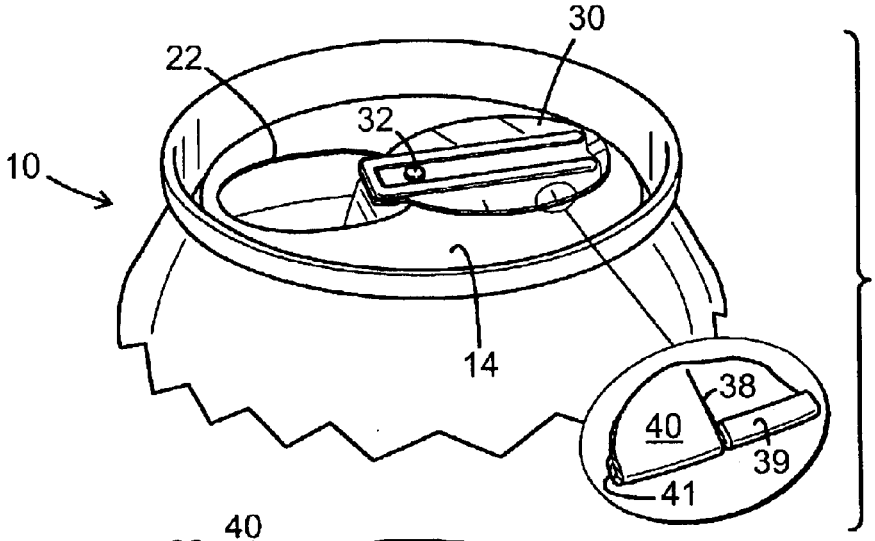
FIG. 2 shows a an oblique top view of a part of a returnable can having a sealing device corresponding to the one shown in FIG. 1 in the opened position.
Figure 3:
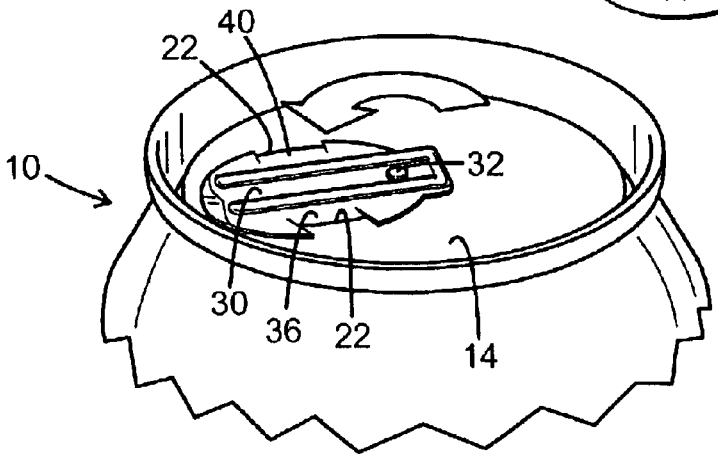
FIG. 3 shows the returnable can shown in FIG. 2 having a sealing device at the resealing position.

In the preferred embodiment shown in FIGS. 1–3, opening device 30 is angled upward somewhat at outer end 46 to make it easier to insert a fingertip under opening device 30 for the opening operation. To avoid risk that the user will cut him/herself on the edges of opening device 30, it can either be made of thicker material or the edges can be bent to form rounded edges as shown at 39 and 41 in the enlarged area in FIG. 2. Preferably, these rounded edges can extend all the way around the periphery (not shown) of the opening device.

Although there may be sufficient resealing if opening device 30 is quite simply only twisted to the resealing position, extra assurance is provided in the embodiment shown in FIGS. 1–3 by making opening device 30 blockable at the resealing position. More precisely, opening device 30 has a pair of slits 34, 38 designed with blocking tabs 36 and 40 respectively, and these tabs provide blocking engagement beneath the edge of opening 22 as shown in FIG. 3. Also as shown in the enlarged area in FIG. 2, tabs 36, 40 (only tab 40 is shown) can, if so desired, be bent slightly down relative to the remaining part of opening device 30 so that they themselves engage beneath the edge of opening 22 when opening device 30 approaches the resealing position.

Preferably, slits 34 are somewhat longer than slits 38, thereby permitting a certain amount of over-twisting of opening device 30 past the resealing position during the engagement of tab 36 before tab 40 is brought into engagement by an equivalent reverse-twisting to the resealing position so that there will be two-sided blocking of opening device 30 at the resealing position. Opening device 30 can be released by opposite reverse-twisting past the resealing position and slight lifting so that tab 40 is released from the edge of opening 22 and so that opening device 30 can then be twisted back clockwise a half revolution to the position shown in FIG. 2. As a rule, allowing only tab 36 to come into one-sided engagement will provide adequate sealing.

Figure 6:
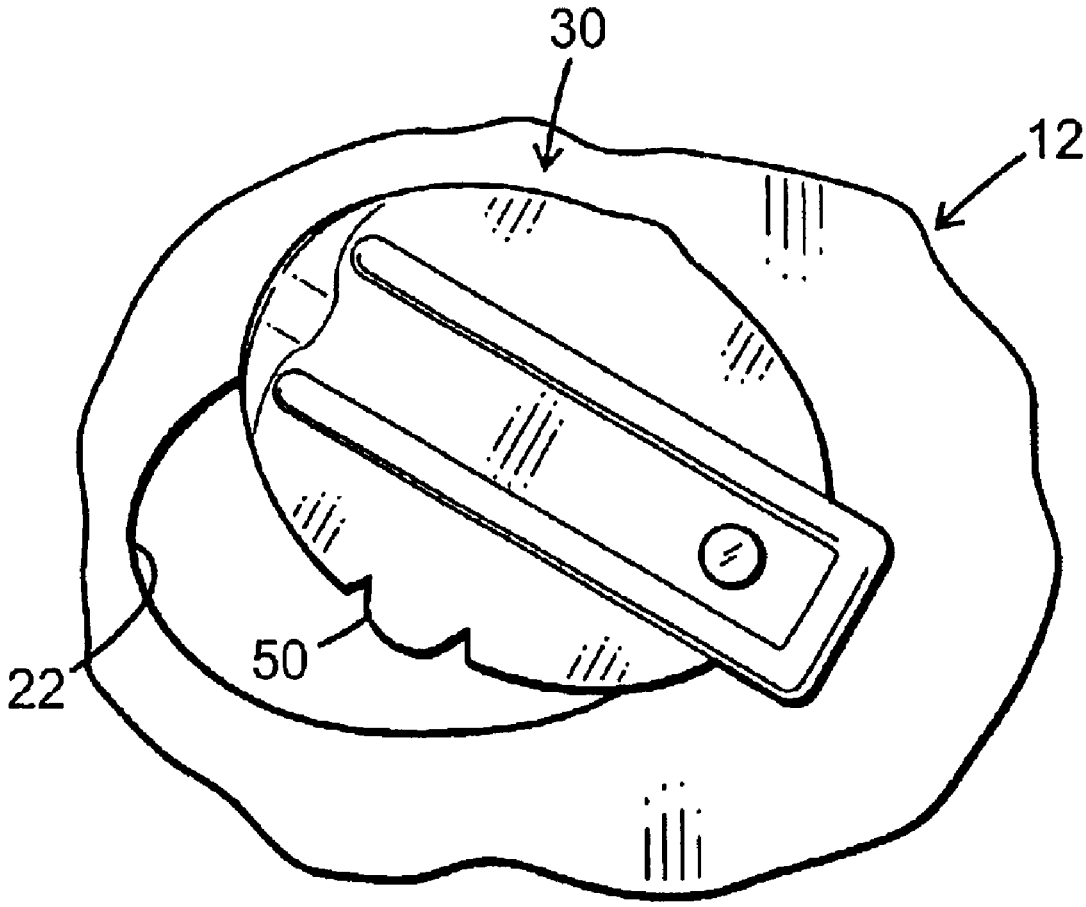
FIG. 6 shows yet another alternative embodiment of a sealing device of the type set forth in this invention.

In the embodiment shown in FIG. 6, opening device 30 has instead, for single-sided engagement, a projecting tongue 50 that provides blocking engagement under the edge of opening 22 at the resealing position. As also indicated in FIG. 6, notches can, but do not necessarily have to, be arranged on the sides of the tongues plus one additional tongue at the opposite side of opening device 30 to provide two-sided blocking of opening device 30. The tongue can also be pointed downwards or designed with a vertical surface (not shown) that forms a stop vis-a-vis the edge of opening 22 at the resealing position. Moreover, both sides of opening device 30 can be arranged with a downward-pointing tongue to provide two-sided blocking of opening device 30 at the edge of opening 22 (not shown).

Figure 4:
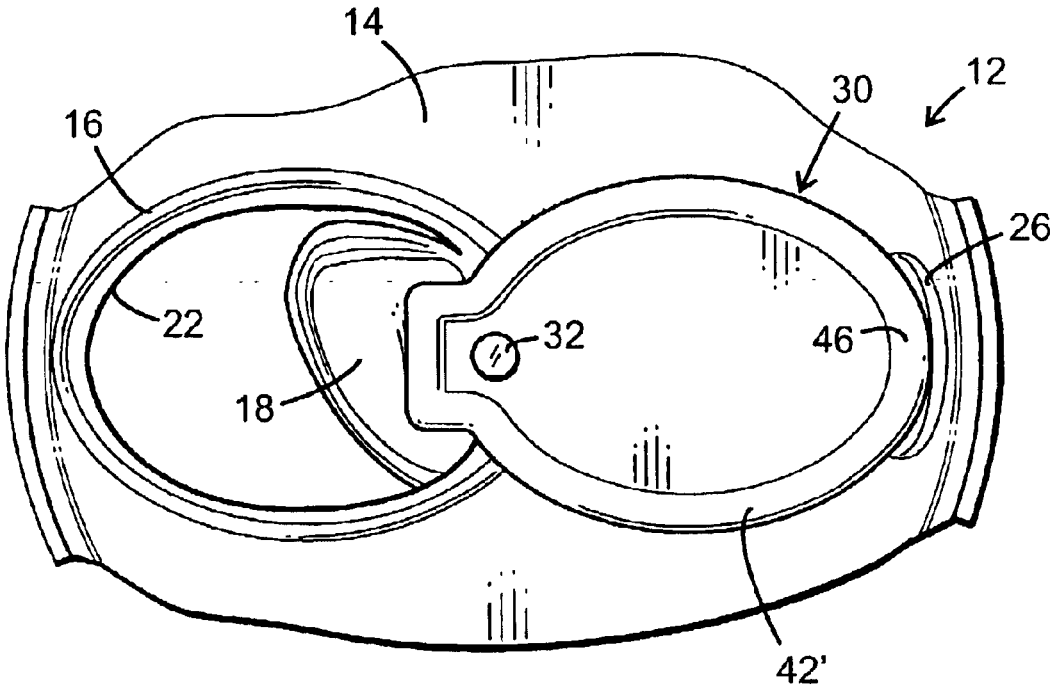
FIG. 4 shows, in the open position, an alternative embodiment of the sealing device shown in FIG. 1.
Figure 5:
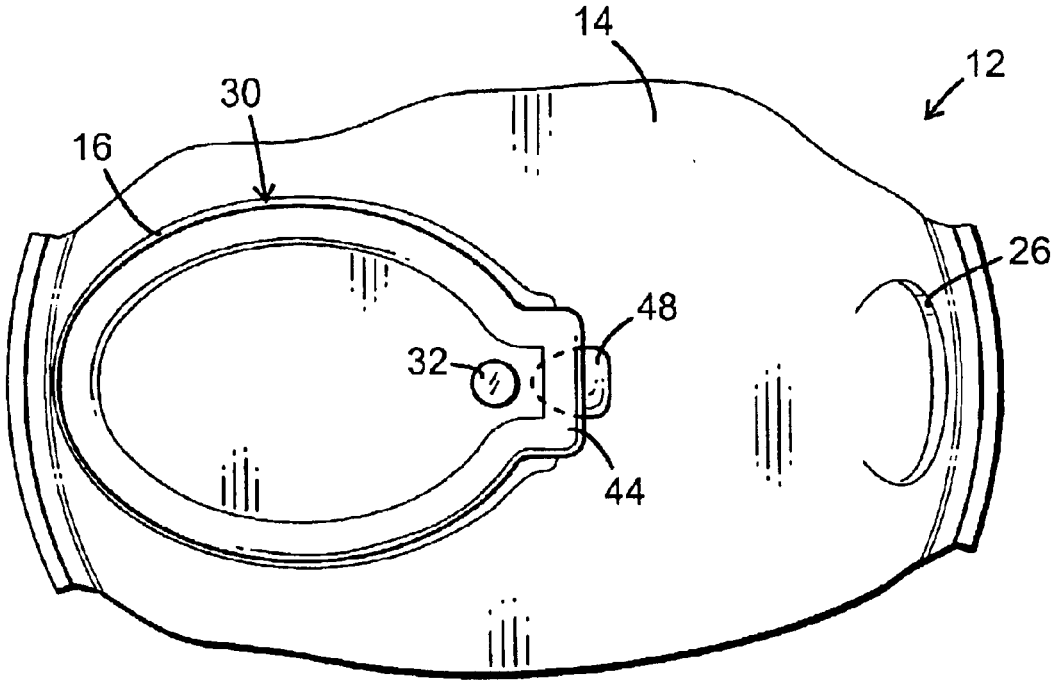
FIG. 5 shows a sealing device corresponding to that shown in FIG. 4 in the resealing position.

In the embodiment shown in FIGS. 4 and 5, opening device 30 has a surrounding, bent thickening/reinforcing edge 42' instead of the U?shaped reinforcing groove 42 shown in FIG. 1. Reinforcing edge 42' extends, in a way not shown, along the under-side of opening device 30 somewhat below the plane of its covering surface so that, by means of a certain amount of fast-snapping catch action, it will collaborate with reinforcing groove 16 which extends around opening 22 at the resealing position as shown in FIG. 5. To hold opening device 30 more securely in place at the resealing position, a rounded, raised projection 48 is arranged in opening area 14 so that it will engage the under-side of the inner end 44 of opening device 30 at the resealing position and, with a leverage action, elastically press the opening device against opening 22. While the returnable can is unopened, raised projection 48 can serve to keep the outer end 46 of opening device 30 angled somewhat upwards to make it easier to insert a fingertip under opening device 30 for the opening operation. For this purpose, opening area 14 can also be provided with a local depression 26. Instead of raised projection 48 in opening area 14, a downward projecting, rounded section (not shown) having essentially the same function can be arranged at the inner end 44 of opening device 30.

Although opening device 30 can fulfil its function without necessarily requiring a gas-tight and watertight seal for opening 22 at the resealing position, if so desired it is possible to provide a sealing coating of suitable plastic material on its under-side (not shown).

Although the sealing device has been illustrated and described in connection with returnable cans, it is not limited to them. Neither is it limited to containers mate of sheet metal. Instead, it is possible to use it with other materials such as plastics. The claims that follow set forth the scope of this invention.

What is claimed is:

1. A sealing device for a container comprising an essentially flat opening area, an opening tab formed in the opening area, and an opening device attached at a connection point in the opening area, and arranged to press down, through leverage action, the opening tab in the opening area so that it creates an opening therein, wherein the opening device is designed to provide resealing of the opening, after having created the opening, by being rotated in parallel with the opening area around the connection point until it reaches a resealing position where it seals the opening with a covering surface, wherein the opening device is provided with blocking devices on its periphery comprising at least one tab formed so that the opening device alternately engages upper and lower edge areas of the opening to block the opening device at the resealing position, and wherein the at least one tab is bounded by slits or other recesses in the opening device.

2. A device in accordance with claim 1, wherein the at least one tab includes a projecting tongue on the opening device.

3. A device in accordance with claim 1 wherein the under-side of an inner end of the opening device is designed to be affected by leverage action at the resealing position so that the opening device is forced in the direction towards the opening.

4. A device in accordance with claim 3, wherein the under-side is affected by a raised projection in the opening area.

* * * * *